US007552749B2

(12) United States Patent
Kageler et al.

(10) Patent No.: US 7,552,749 B2
(45) Date of Patent: Jun. 30, 2009

(54) POWER TOOL

(75) Inventors: Sven Kageler, Leinfelden-Echterdingen (DE); Marco Braun, Penang (MY); Rezwan Iskandar Jalil, Simpang Ampat (MY); Mohamed Zaidi Ahmad, Merbok Kedah (MY)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/178,763

(22) Filed: Jul. 11, 2005

(65) Prior Publication Data

US 2006/0008334 A1 Jan. 12, 2006

(30) Foreign Application Priority Data

Jul. 12, 2004 (DE) ..... 10 2004 033 801

(51) Int. Cl.
*B27C 5/10* (2006.01)

(52) U.S. Cl. ..... 144/136.95; 144/154.5; 409/182

(58) Field of Classification Search ..... 144/136.95, 144/154.5, 48.5; 409/180–182
See application file for complete search history.

(56) References Cited

U.S. PATENT DOCUMENTS

| | | | | |
|---|---|---|---|---|
| 3,022,806 | A * | 2/1962 | Johnston | 144/252.1 |
| 4,319,860 | A | 3/1982 | Beares | |
| 5,370,165 | A * | 12/1994 | Stornetta | 144/144.1 |
| 5,613,813 | A * | 3/1997 | Winchester et al. | 409/182 |
| 5,853,274 | A | 12/1998 | Coffey et al. | |
| 6,027,289 | A * | 2/2000 | Posh | 409/180 |
| 6,443,675 | B1 * | 9/2002 | Kopras et al. | 409/182 |
| 6,725,892 | B2 * | 4/2004 | McDonald et al. | 144/136.95 |
| 6,726,414 | B2 * | 4/2004 | Pientka et al. | 409/182 |
| 6,779,954 | B2 * | 8/2004 | Tomayko | 409/182 |
| 6,835,030 | B2 * | 12/2004 | Pozgay et al. | 408/182 |
| 2003/0002947 | A1 | 1/2003 | Hathcock et al. | |
| 2003/0223836 | A1 | 12/2003 | Pozgay et al. | |

FOREIGN PATENT DOCUMENTS

| | | |
|---|---|---|
| DE | 196 37 690 A1 | 3/1997 |
| EP | 1 238 767 | 9/2002 |
| GB | 2392 135 | 3/2004 |
| JP | 9-309078 | 12/1997 |
| WO | 2005/058542 | 6/2005 |

* cited by examiner

*Primary Examiner*—Shelley Self
(74) *Attorney, Agent, or Firm*—Michael J. Striker

(57) ABSTRACT

A power tool has a housing, a tool, and a guard embracing the tool that is coupleable to the housing and axially adjustable relative, so that it is safer to handle because the guard is designed as a support foot and on its outside has a jacket piece of plastic with a nonslip, rough outer surface.

22 Claims, 8 Drawing Sheets

POWER TOOL

BACKGROUND OF THE INVENTION

The present invention is based on a power tool.

From German Patent DE 196 37 690 C2, a power tool designed as a top spindle molder with cutting depth adjustment is known, which permits relatively safe, convenient adjustment of the cutting depth, but a continuously variable manual rapid adjustment is not possible, and the grip region of the support foot, while it is of plastic and is nonslip, is nevertheless markedly less stable than a support foot of that kind of metal, such as aluminum.

SUMMARY OF THE INVENTION

Accordingly, it is an object of the present invention to provide a power tool which eliminates the disadvantages of the prior art.

In keeping with these objects and with others which will become apparent hereinafter, one feature of the present invention resides, briefly stated, in a power tool, comprising a housing; a tool; guard means embracing said tool, said guard means being couplable to said housing and axially adjustable relative to said housing, said guard means being configured as a support foot and composed of metal, said guard means on an outside having a substantially congruent jacket piece composed of non metal.

When the power tool is designed in accordance with the present invention, it has the advantage that a top spindle molder has thus been created whose support foot unites the stability of a metal construction with the nonslip nature of a soft plastic, and both the attainable work precision and the fast and precise adjustment of the cutting depth can be made in a way that is safely checkable, and the means provided for that purpose are simple to manufacture and install as well as being economical, sturdy, and easy to operate.

Because the adjusting positions between the housing and the guard means can be changed quickly, safe, precise fine adjustment of the cutting depth position is possible immediately after a quick coarse adjustment has been done.

Because the adjusting positions between a coarse and a fine adjustment can be changed between the housing and the guard means by means of a relative rotation, the cutting depth adjustment can be done especially simply and in a time-saving way.

Because the guard means is designed as a support foot which annularly embraces the housing and can be switched over into two defined rotary positions, which define a fine adjustment stage and a coarse adjustment stage for changing the axial position of the housing relative to the support foot, a simple, operationally safe switchover of the power tool in the cutting depth adjustment is possible.

Because the two rotary positions are defined, overlooking immediately adjacent to one another, with minimal rotary travel of the housing relative to the support foot, the rotary position can be adjusted in a way that can be quickly changed.

Because overlooking means between the housing and the support foot make every change in the adjustment stage audible and perceptible by touch, they secure these parts against being changed unintentionally.

Because the housing has a steplike collar onto which the support foot can be slipped, and the outer contour of the housing makes a smooth transition to the outer contour of the support foot that has been slipped all the way on, and in this position of the housing relative to the support foot the minimum telescopic extension position and hence a maximum cutting depth for the tool is set, the mutual rotation of the support foot and the housing in the transition region between them can be sensed safely and monitored by the user's hand in the switchover process.

Because there is a depth stop between the housing and the support foot, which stop in the first adjustment stage does not engage the space between the housing and the support foot but does adjustably engage in the second adjustment stage, an axial coarse adjustment stage of the housing relative to the support foot is possible in the first adjustment stage, and from that adjustment, after switchover to the second adjustment stage, the final cutting depth can be finely set by rotating the depth stop.

Because the depth stop is designed as a screw bolt, on one end of which an adjusting wheel is seated in a manner fixed against relative rotation, with which adjusting wheel the depth stop is located, drivable to rotate but axially secured, in the support foot, the depth stop, in the fine adjustment stage, by rotation by hand, can adjust the housing axially finely relative to the support foot, and in the first adjustment stage it remains without engagement with the housing, and moreover upon release of the housing from the support foot can remain secured in the support foot against being lost.

Because the adjusting wheel passes through the support foot to the outside in a way that can be operated by hand, and the screw bolt rests longitudinally parallel in a groove in an inside of the wall of the support foot in a form-locking way over approximately half the length and, with its protruding longitudinal region on the diametrically opposite side is associated with a parallel outer longitudinal housing groove, the depth stop can be adjusted from outside especially safely—without the risk of injury to the hand of the user by the tool.

Because, next to the one longitudinal housing groove, there is a further longitudinal housing groove, in particular with a female thread, which fits the thread of the depth stop and into which the screw bolt can be placed longitudinally when it is placed in the one longitudinal housing groove, fine adjustment of the housing relative to the support foot is possible, and upon placement in the other longitudinal housing groove, a free axial adjustment of the housing relative to the support foot is possible by hand.

Because the center spacing of the longitudinal housing groove is less than the groove diameter, the switchover travel distance for changing the adjustment stages is especially short.

Because between the longitudinal housing grooves, at the transition from one to the other, overlooking means are provided which positionally secure the screw bolt in an overlooking fashion in its respective longitudinal housing groove, an unintentional change of the adjustment stages is precluded.

Because one of the longitudinal housing grooves has fitting thread means that are capable of engaging the screw bolt, a replicable fine adjustment of the housing relative to the support foot is possible upon rotation of the screw bolt by way of actuation of the adjusting wheel.

Because the other of the longitudinal housing grooves embraces the screw bolt with radial play without engagement, in the second adjustment stage the housing can be easily adjusted freely axially relative to the support foot between the two end points of the axial position, by quasi-free axial displacement.

Because as the overlooking means between the longitudinal housing grooves, a parallel bolt seeks to be braced in spring-prestressed fashion radially movably outward, that is, longitudinally toward the support foot counter to the screw bolt of the depth stop, a large-area, safe to use overlooking means between the support foot of the housing is created.

Because the collar of the housing and/or the upper edge, which can be braced on it, of the sleevelike shaft of the support foot extends obliquely, the correct reinsertion of the housing into the support foot after they have been manipulated separately is safe to use. Because the adjusting positions are releasably lockable, in particular by clamping means, and thus can be defined axially and radially, the cutting depth of the power tool can be set in an assured way.

Because the support foot is dimensioned such that the power tool can be set with its help freely standing on a horizontal, level surface, especially precise, tilt-proof work with the power tool is possible.

Because the housing is limited relative to the support foot in its axial end positions upon longitudinal displacement by means of stops, in particular by a bayonet mount, unintentional release or loss of the support foot from the housing and vice versa is precluded.

Because scale means for monitoring the cutting depth are located between the housing and the support foot, their cutting depth position, particularly in the fine adjustment stage, can be safely controlled and adjusted replicably.

Because the power tool is designed as a top spindle molder, and the various set positions each correspond to a certain cutting depth, the power tool can be adjusted and safely handled in an especially time-saving way.

Because the adjustment means, described above in terms of their advantages, serve to vary or fix two parts, telescoping one inside the other, relative to one another, it can also be used especially advantageously—with its own inventive importance—in still other kinds of application than-in power tools, in which both fast and especially precise setting of the relative position is necessary.

The invention is described in further detail below in terms of one exemplary embodiment, in conjunction with the drawings.

DESCRIPTION OF THE PREFERRED EMBODIMENTS

Figure 1:
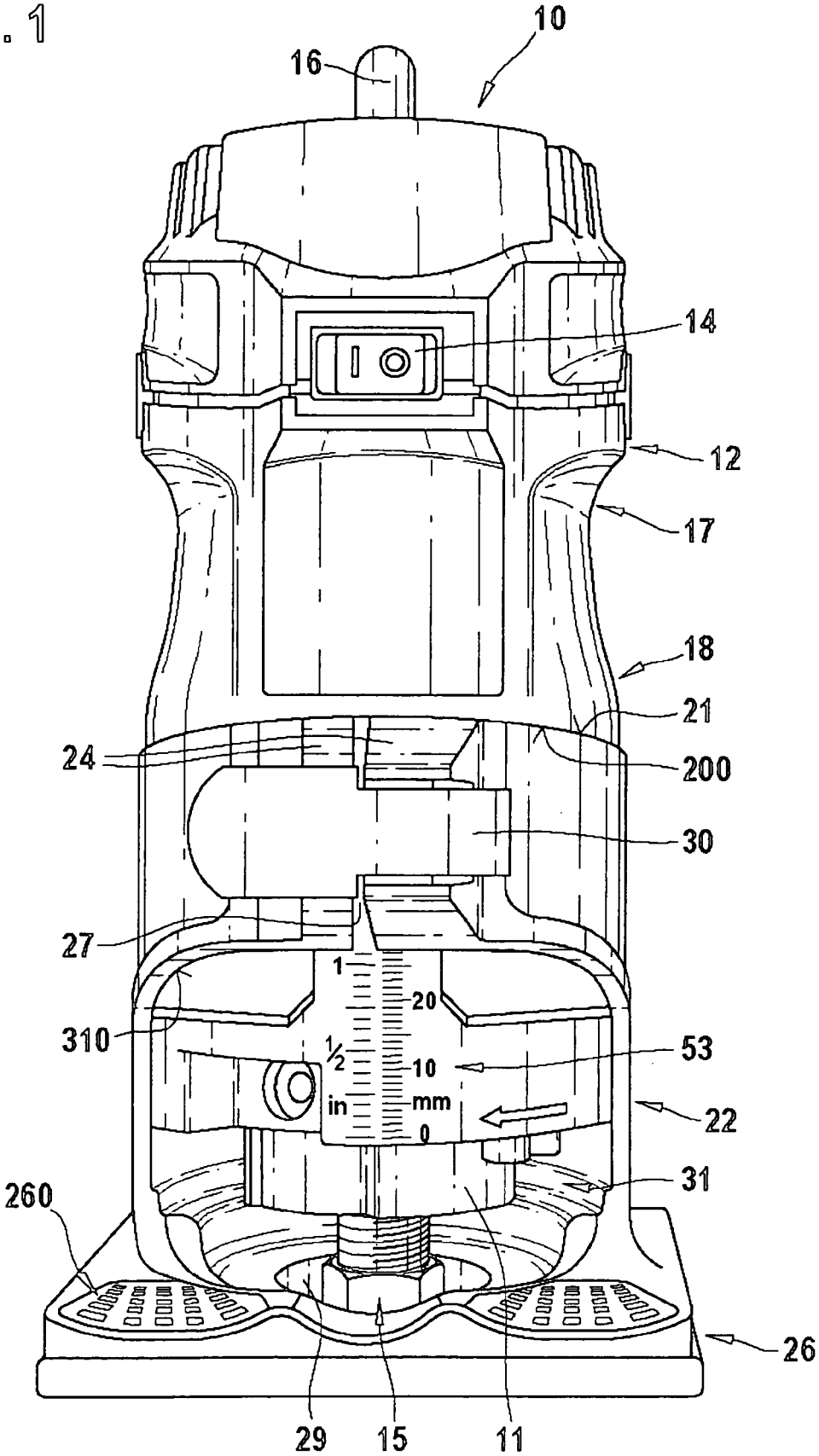
FIG. 1 shows the power tool from the front.

As an electrically powered top spindle molder, which comprises a housing 12 that has a push button 14 at the front for turning it on and off, and from whose lower free end 11 a rotating tool 15 for machining of workpieces protrudes.

The cylindrical housing 12, in the uppermost quarter of its length, has a waist 17, which can easily be grasped with one hand and, with its radial projection conforms in an axially supportive way to the hand holding it. The lower half of the housing 12 has a slightly smaller outer diameter than the upper region, and with the smaller diameter forms a collar 20 (FIG. 3), which can be slid in telescoping fashion into a hollow-cylindrical support foot 22. The transition between the collar 20 and the upper region of the housing 12 forms a projection or an edge 200 that can be felt.

This edge 200, located between the collar 20 and the region of the housing 12 located above it and having the larger diameter, extends rearward—matching the upper edge of the support foot 22—in a way inclined obliquely downward.

From the upper housing region, an electrical connection cable 16 extends upward with a slight inclination. By means of its exiting direction and its inclination, it is kept reliably spaced apart from the point of engagement of the tool 15 with a workpiece, without hindering the work in the way that happens with cables that emerge at the top perpendicularly.

The hollow-cylindrical support foot 22 has a vertical, tubular support foot wall 23, which is longitudinally slit at the front; at the slit 27, two lateral perforated clamping tabs 24 that protrude to the front are formed. A clamping screw 25 (FIG. 2) can be inserted through these clamping tabs, transversely to the longitudinal axis of the support foot 22. If the clamping screw is tightened, the two clamping tabs 24 move toward one another and in the process seek to close the slit 27. In that process, they firmly clamp the collar 20 of the housing 12 that is seated in the support foot 22—in a way that is secure against rotation and axial displacement. Thus a cutting depth of the tool 15, once set, is securely fixed against unwanted change. The clamping screw 25 is a fast-action clamping screw with a pivot lever 30 with an eccentric region, not identified by reference numeral, of the kind known for instance for adjusting the height of bicycle saddles, and can be released and tightened by means of the pivot lever 30. The pivot lever 30 of the clamping screw 25 is hinged against the support foot 22 in the tightened state and drawn largely into the contour of the support foot. As a result, when the user is manipulating the top spindle molder 10, for instance when striking edges of workpieces, the pivot lever 30 is precluded from falling open.

Below the clamping tabs 24, the support foot wall 23 opens up over its entire width all the way down to the base plate 26 to form a windowlike front recess 31. The base plate 26 on the lower end of the support foot 22 is substantially square and protrudes past the outer contour of the cylindrical support foot 22 at the sides, back and front. Its area is dimensioned such that the top spindle molder 10 with the support foot 22 can be set down, standing freely, securely and stably on a level support.

The cutting depth for the tool 15 can be set in a controllable way by means of a scale 53 on the lower edge of the housing 12; the scale position relative to the adjacent upper edge 310 of the windowlike front recess 31 can be read off in the form of a reference edge.

The base plate 26 has a vertical opening 29, designed as a circular hole, for the passage of the tool 15 downward into a workpiece to be machined. By axial adjustment of the top spindle molder 10 or housing 12 relative to the support foot 22, the depth to which the tool 15 plunges into a workpiece to be machined can be set.

On the outside at the back and sides, the housing 12 and the support foot 22 are provided, in the grip region 18, with uniformly distributed cup-shaped indentations 19, which have a diameter of approximately 2 to 3 mm and improve the grip and hence safety of operation of the top spindle molder 10. A grip region with an especially securely nonslip ribbing 260 made up of rectangular embossed features is formed on the top side of the base plate 26.

Figure 2:
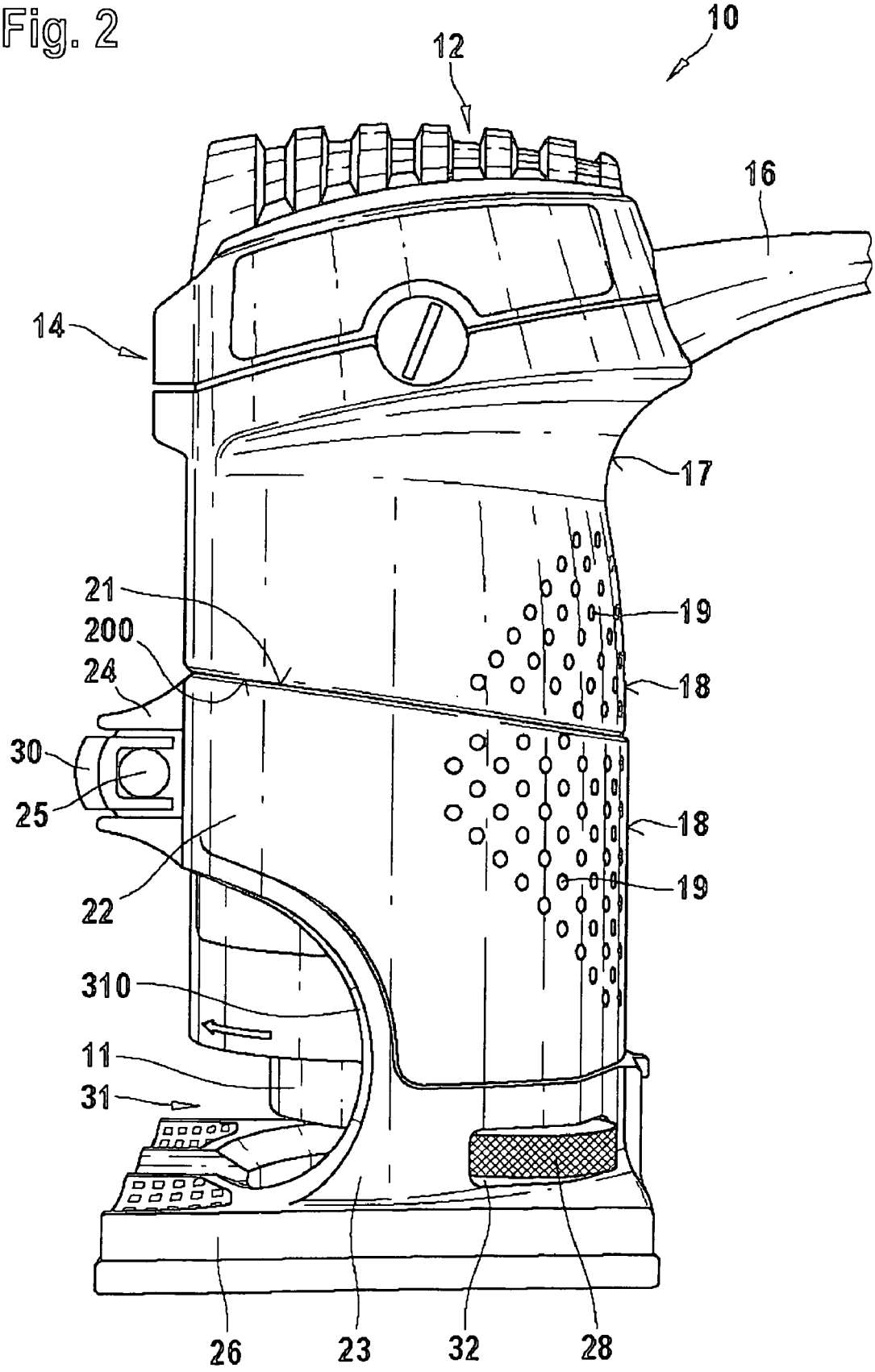
FIG. 2 shows the power tool from the left.

FIG. 2 shows the left-hand side of the top spindle molder 10, in which in particular—going beyond FIG. 1—the obliquely upward and rearward extending electric cable 16, the housing 12 that is ribbed transversely at the top, and the clamping tabs 24 protruding to the front are visible along with the pivot lever 30. The grip region 18 with the cup-shaped indentations 19 and the edge 21 dropping obliquely rearward of the support foot 22, and correspondingly the protruding edge 200 on the collar 20, as well as the shape of the front recess 31 with the curved edge and a transition to the relatively far-forward-protruding base plate 26 can also all be seen.

Figure 3:
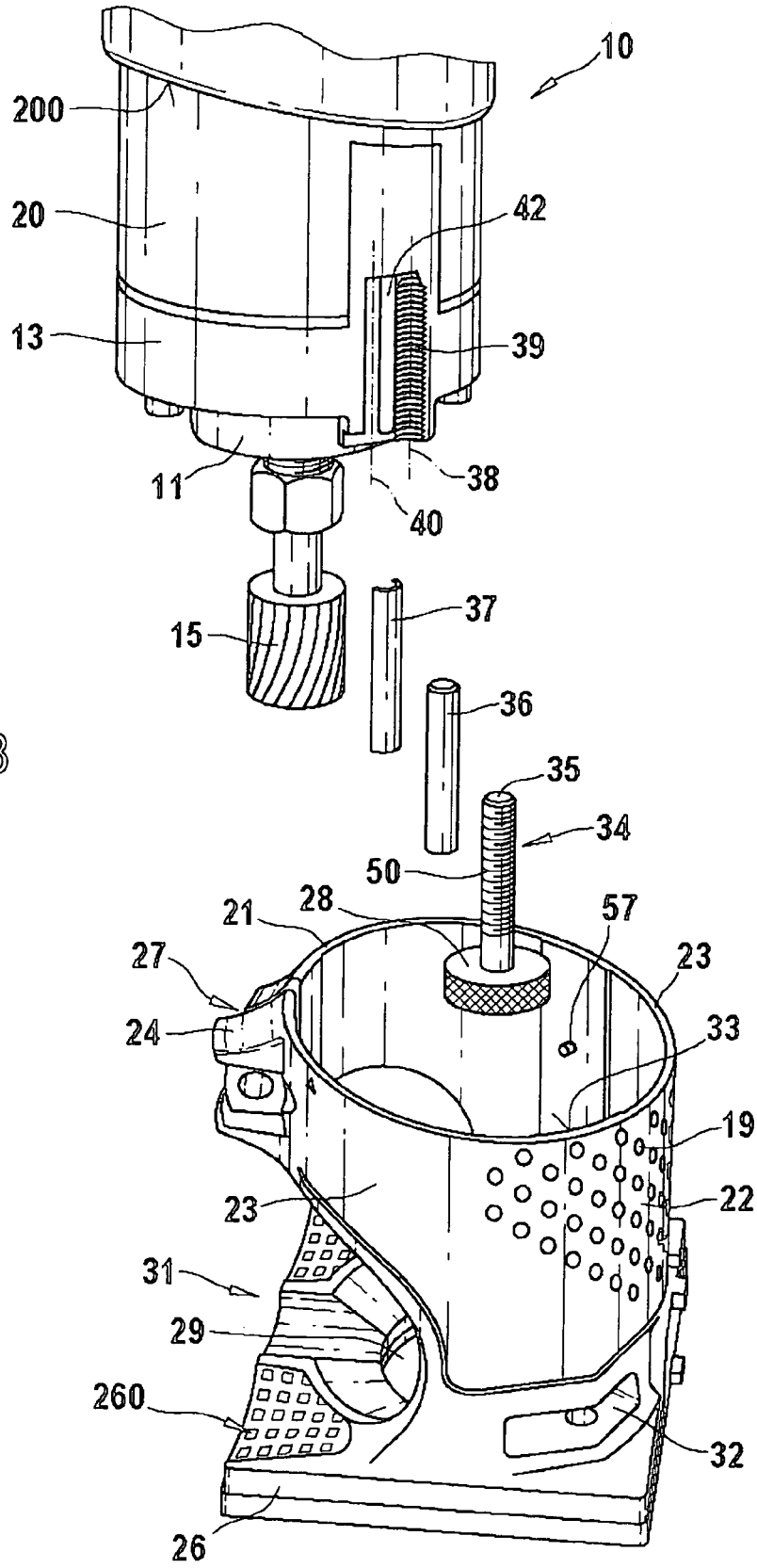
FIG. 3 shows the support foot and the power tool in an exploded view, axially taken apart.

In the rear at the side, in the lower region of the support foot 22, an adjusting wheel 28 can be seen, which emerges from a transverse slit 32 in the support foot wall 23 and has a threaded bolt 35 (FIG. 3)—not visible here—which extends in the interior between the housing 12 and the support foot wall 23 and serves as a depth stop 34 (FIG. 3).

FIG. 3 is an exploded view of the top spindle molder 10 positioned above the support foot 22; of the top spindle molder, only the lower region having the collar 20, the lower free end 11 and the tool 15 are visible. The edge 200 between the upper region of the housing 12 and the collar 20 is clearly visible. In the case of the support foot 22, the clamping screw 25 has been removed, to make the design of the perforated clamping tabs 24 and the slit 27 between the two clamping tabs visible. Also visible are the upper edge 21 of the support foot 22 and the transverse slit 32 for the adjusting wheel 28 in the lower region of the support foot 22, above the base plate 26. The depth stop 34 with the adjusting wheel 28 has been removed from its emplaced position in the inside surface of the support foot wall 23. To that end, a retaining screw, not shown, that engages the adjusting wheel centrally from below must first be removed; in the installed position, it secures the depth stop 34 on the support foot 22 against being released unintentionally.

The depth stop 34, in its upper region, is designed as a screw bolt 35 with a thread 50. The screw bolt 35 is provided for selective entry into a first or a second longitudinal housing groove 38, 40 in the outer wall of the housing 12 in the region of the collar 20. The two longitudinal housing grooves 38, 40 extend parallel to the screw bolt 35, or to its longitudinal groove 33 (FIG. 5), in the inside face of the support foot wall 23. Approximately centrally between and parallel to the longitudinal housing grooves 38, 40, an overlooking bolt 36 is placed in a slit 42 in the housing wall 13 in the region of the collar 20 in such a way that it cannot fall out radially outward through the suitably narrow slit 42; it is kept prestressed radially outward in the slit 42 from behind by a leaf spring 37.

If the housing 12 has been inserted axially in telescoping fashion into the support foot 22 as intended, then the screw bolt 35 rests in one of the longitudinal grooves 38, 40. If the housing 12 is meant to be rotated slightly relative to the support foot 22 such that the screw bolt 35 is meant to emerge laterally outward from the pair of longitudinal housing grooves 38, 40, then this direction of rotation is blocked. Conversely, however, the housing 12 can be rotated counter to the force of the leaf spring 37 and of the overlooking bolt 36; depending on the rotation travel, the threaded bolt 34 snaps audibly into whichever longitudinal housing groove 38, 40 is adjacent to it. Before the housing 12 is rotated relative to the support foot 22, the pivot lever 30 of the clamping screw 25 must be put into its release position, so that the slit 27 between the clamping tabs 24 opens, and the force lock between the support foot 22 and the housing 12, or collar 20, is released.

The first longitudinal housing groove 38 has a thread 39 that fits the thread 50 of the screw bolt 35. If the longitudinal housing groove 38 is in engagement with the screw bolt 35, then upon its rotation, or the rotation of the adjusting wheel 28, the housing 12 is axially adjusted relative to the support foot 22. If the second longitudinal housing groove 40 is in engagement with the screw bolt 35, then no form lock or force lock becomes operative between it and the housing 12. As a result, in this position, the housing 12 is easily slid back and forth axially by hand relative to the support foot 22 between two defined axial end positions. In this position, a coarse preselection of the cutting depth can be done simply and quickly by axial displacement. Once the cutting depth position has been coarsely set, the housing 12 should be rotated relative to the support foot 22 such that the screw bolt 35 enters in overlooking fashion into the first longitudinal housing groove 38, so that in that position, by rotation of the adjusting wheel 28, the meshing threads 39, 50 bring about an axial transfer of force with a finely meterable longitudinal adjustment. Once the desired cutting depth position is reached, then pivoting of the pivot lever 30 into its clamping position, the housing 12 is locked relative to the support foot 22, so that neither a rotary nor an axial motion between these two parts is possible. Thus the cutting depth position of the housing 12 relative to the support foot 22 is set. Depending on the selected cutting depth, the tool 15 protrudes more or less far outward past the lower edge of the base plate 26, with a corresponding cutting depth, into a workpiece to be machined, onto which workpiece the base plate 26 should be placed.

On the right, in the viewing direction, below the adjusting wheel 28, a radially inward-protruding cam 57 can be seen, seated on the inside of the support foot wall 23; this cam is intended for securing engagement with a bayonet groove 55 (FIG. 8) in the housing 12.

Figure 4:
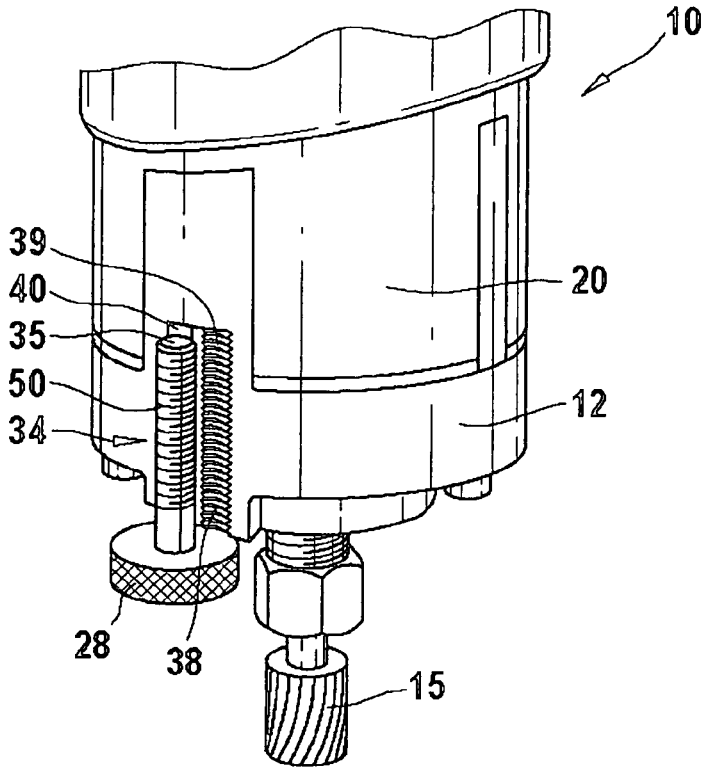
FIG. 4 shows the power tool without the support foot and with the depth stop.

FIG. 4 shows a side view of the top spindle molder 10 in the region of the collar 20, with a depth stop put in place—for purposes of demonstration—that was previously removed from its installed position in the support foot 22. This depth stop 34 is placed in the second longitudinal housing groove 40, without a thread, and is freely displaceable axially in it and cannot take on any locking force transfer function between the support foot 22 and the housing 12. This demonstrates the course adjustment position, in which the housing 12 is limitedly freely displaceable relative to the support foot 22.

In the first longitudinal housing groove 38, parallel to the second longitudinal housing groove 40, the thread 39 is visible, which upon engagement of the depth stop 34 prevents an axial displacement between the housing 12 and the support foot 22 as a result of forces from outside exerted on these two parts, and allows axial displacement of them only by means of rotation of the adjusting wheel 28.

The other details recited in conjunction with the above drawing figures will—with reference to existing reference numerals that are the same—not be repeated again here.

Figure 5:
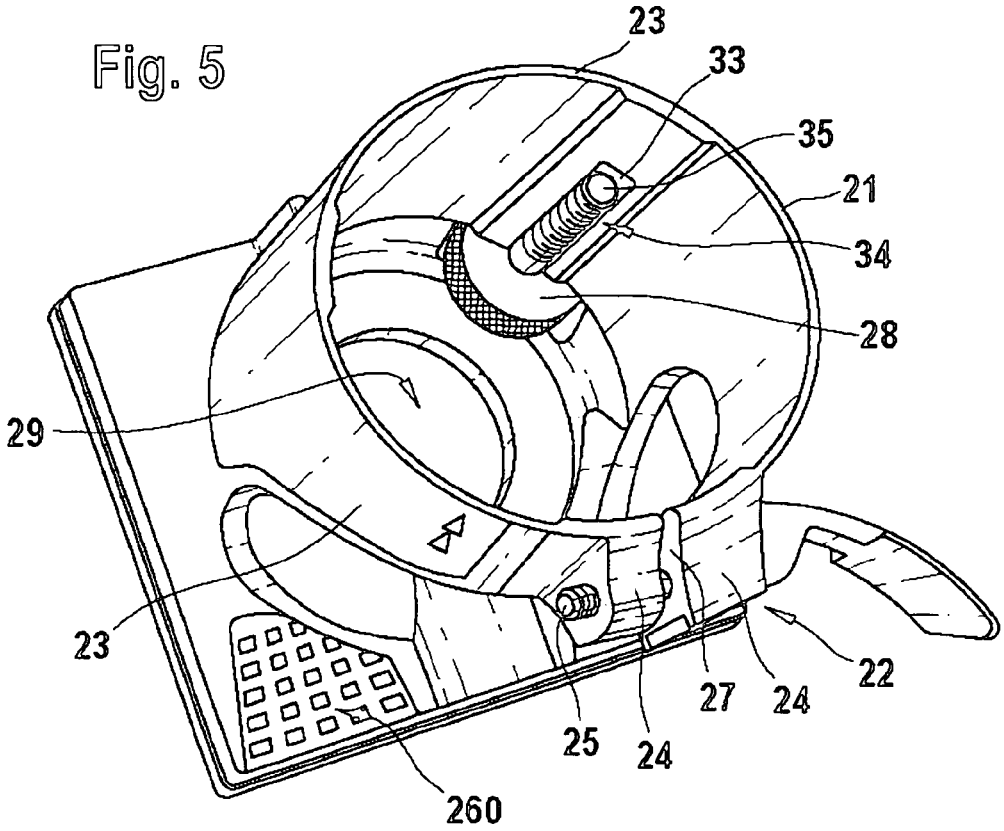
FIG. 5 shows the support foot from above with the depth stop.

FIG. 5 shows the detail of the support foot 22, in which beyond the above drawings, the depth stop 34 is shown in its emplaced position on the inside face of the support foot wall 23, in which the screw bolt 35 rests freely rotatably with radial play but axially nondisplaceably in the longitudinal groove 33 of the support foot wall 23. Moreover, the slit 27 between the clamping tabs 24 in the support foot 22 is clearly visible.

The other details described in conjunction with the previous drawings will not be repeated here.

Figure 6:
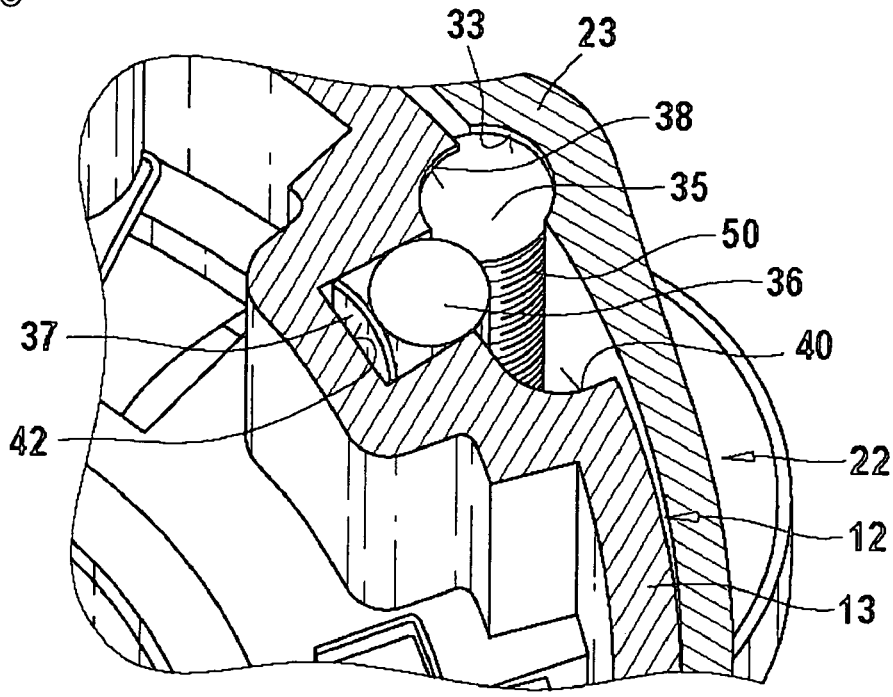
FIG. 6 is an enlarged cross section between the support foot and the housing with the depth stop, in the fine adjustment stage.

FIG. 6 is an enlarged detail of the cross section between the support foot wall 23 and the housing wall 13 in the region of the longitudinal housing grooves 38, 40, with threaded bolts 35 in place; on the opposite side, the longitudinal groove 33 is shown in the support foot wall 23. This makes the overlooking and action positions of the screw bolt 35 clear.

Figure 7:
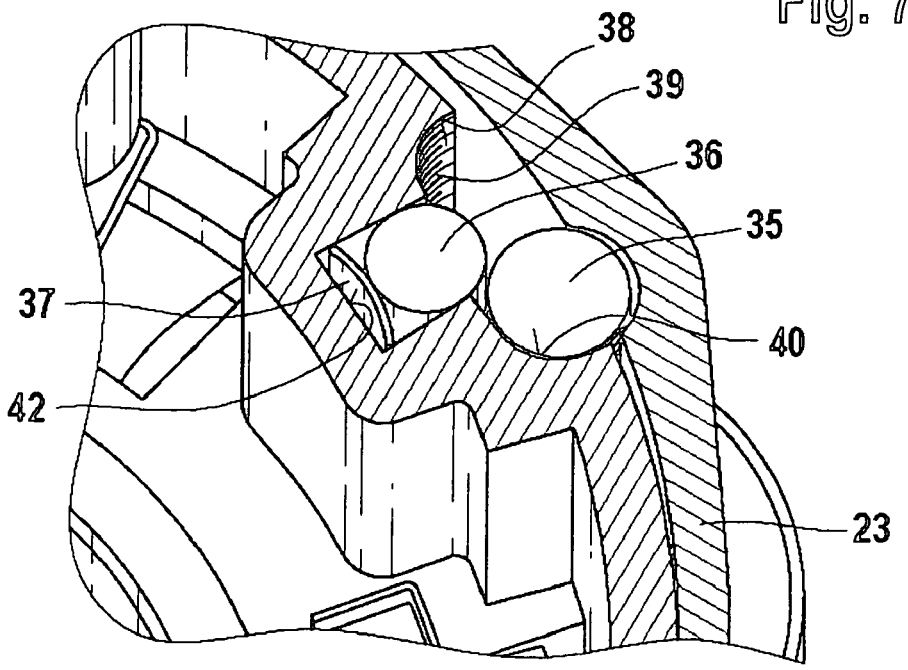
FIG. 7 is the same view as FIG. 6, in the coarse adjustment stage.

FIG. 7 shows the same details as FIG. 6, but with the housing 12 rotated relative to the support foot 22; the threaded bolt 35 rests in the second longitudinal housing groove 40 and makes free displacement of the housing 12 relative to the support foot 22 possible.

Figure 8:
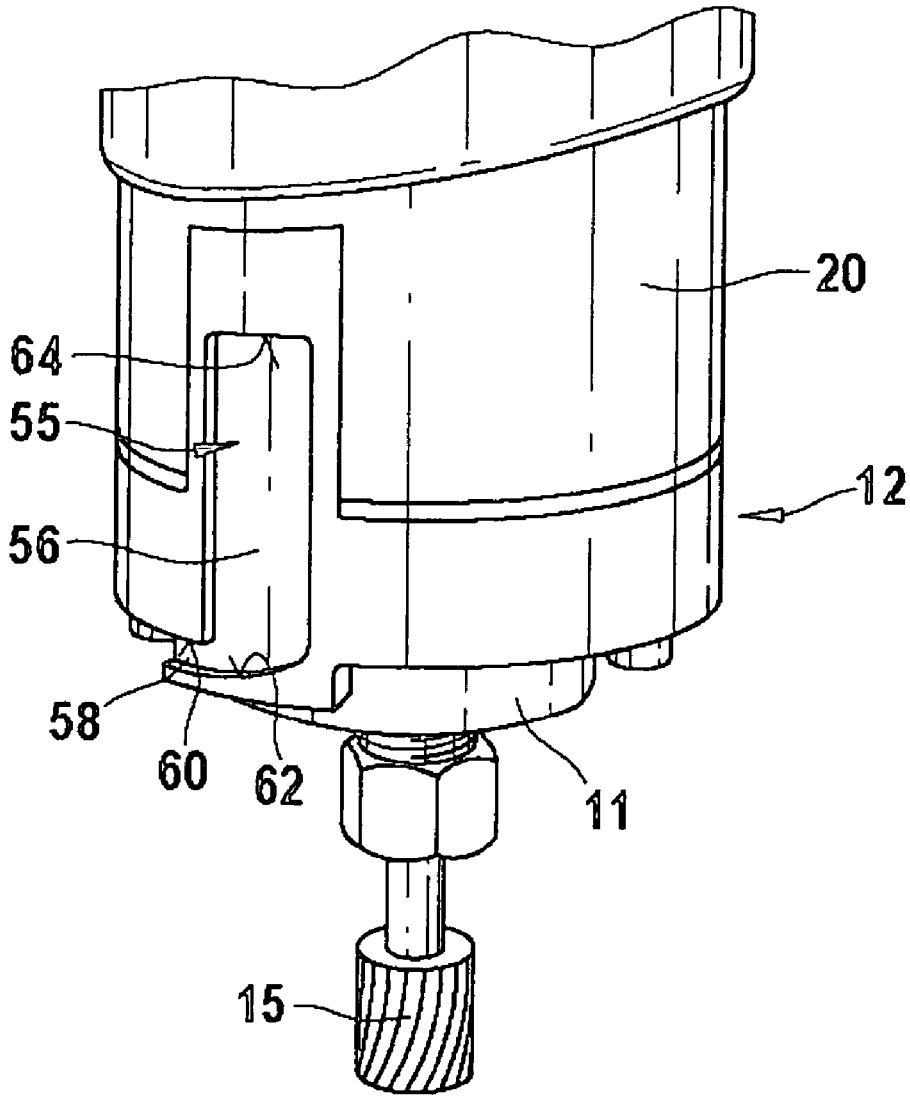
FIG. 8 is a further side view of the housing.
Figure 9:
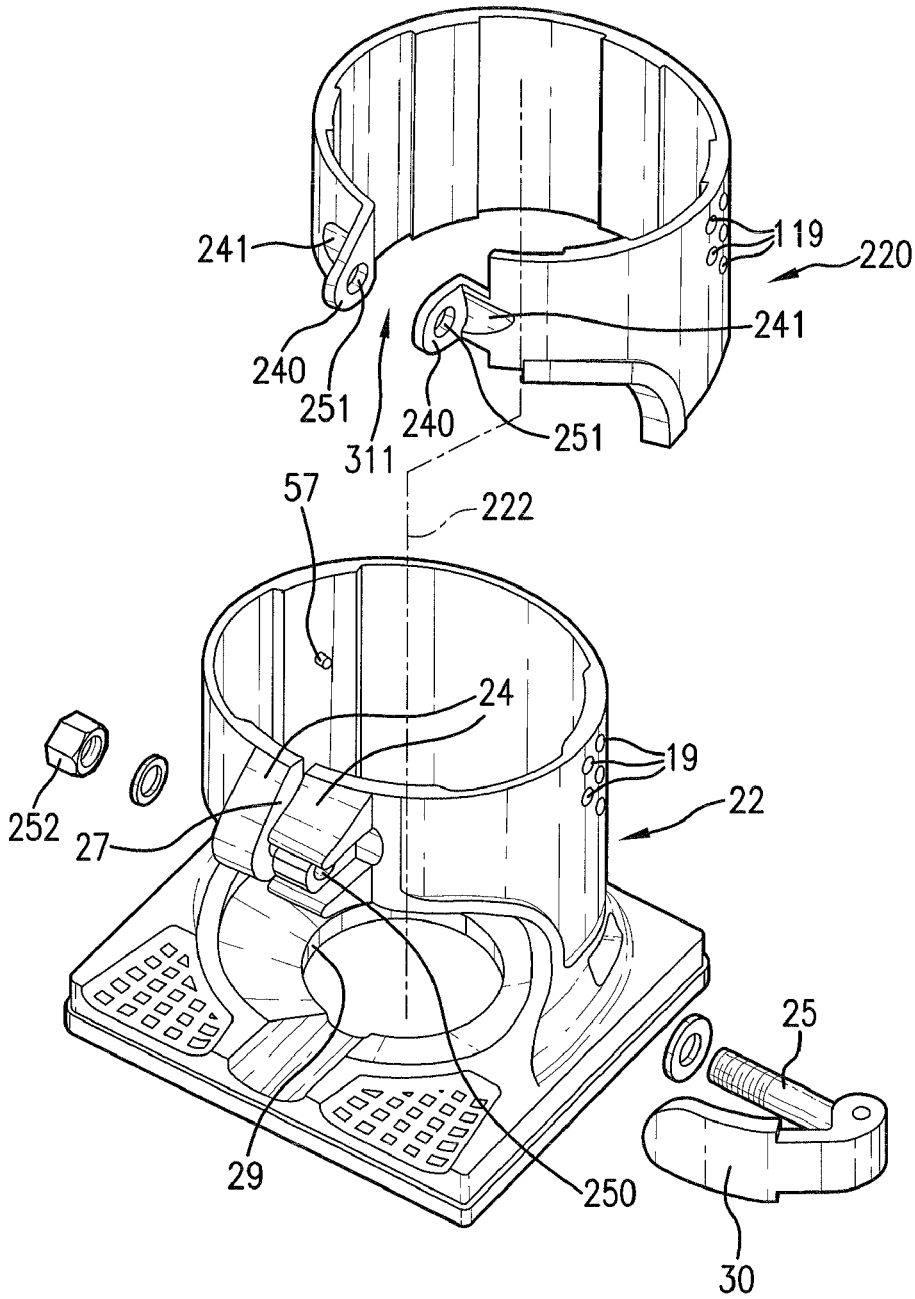
FIG. 9 is an exploded view of the jacket.

FIG. 8 shows a further side view of the housing 12 with its collar 20, looking toward an L-shaped bayonet groove 55. This groove is composed of an upper, wide region 56, which extends vertically, and a narrow, angled region 58 with which the wide region merges. As a locking or stop element, a cam 57, which is seated on the inside of the hollow-cylindrical support foot wall 23 (FIG. 9) and protrudes radially inward, engages the bayonet groove 55.

The cam 57 is brought into engagement with the bayonet groove 55 as follows: First, the housing 12 should be placed axially onto the support foot 22. In the process, the region 58, opening laterally downward, of the bayonet groove 55 is slipped over the cam 57 until further axial displacement of the housing 12 relative to the support foot 22 is stopped because of the fact that the cam 57 strikes against the upper groove wall 60 of the region 58. By appropriate rotation of the housing 12 relative to the support foot 22, the cam 57 is guided on the groove wall 60 until it reaches the upper region 56. Once this position of the cam 57 is reached, the housing 12 is longitudinally freely displaceable relative to the support foot 22, as long as the threaded bolt 35 at the same time rests in the second longitudinal housing groove 40. So that the cam 57 will not hinder the adjustment of the rotary positions of the housing 12 relative to the support foot 22 and is axially freely movable in each rotary position, the upper region 56 of the bayonet groove 55 is designed to be correspondingly wide.

An upper groove end 64 and a lower side wall 62 of the region 58 of the bayonet groove 55 are used for limiting the axial motion between the support foot 22 and the housing 12 and at the same determine their outermost axial end positions, and the cam 57 rests on them in the respective end position. This prevents unwanted release of the support foot 22 from the housing 12 when the clamping screw 25 is open.

To facilitate the mounting of the support foot 22 on the housing 12, arrowlike symbols, not identified by reference numerals, are stamped into the housing 12 and the support foot 22, marking those regions of the housing that belong together or are to be aligned with one another as such in a visible way and at the same time describe a prerequisite mounting motion.

Figure 10:
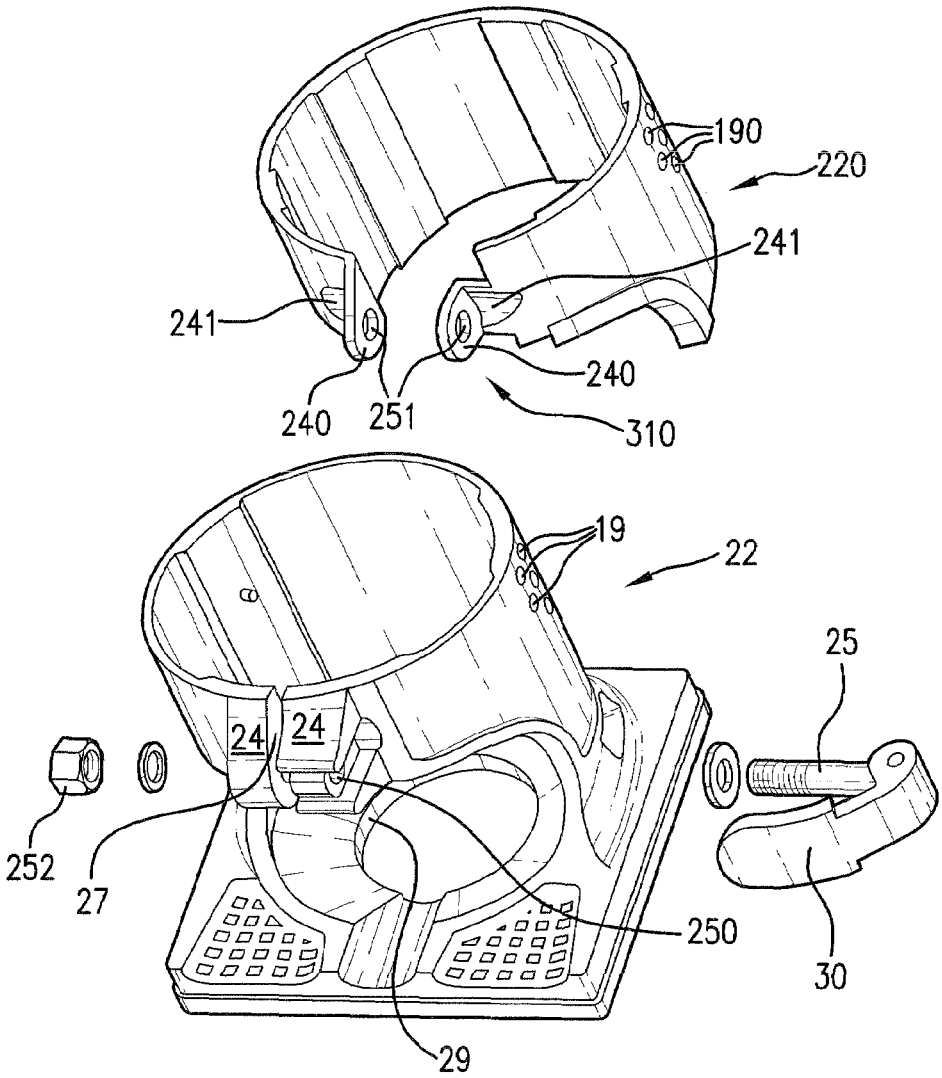
FIG. 10 is an exploded view of the support foot with the jacket piece.

FIG. 10 shows an exploded view of the support foot 22, in which the clamping tabs 24 are clearly visible, spaced apart from one another by a longitudinal slit 27, through which, aligned with one another a transverse bore 250 extends, through which the clamping screw 25 can be inserted, with which clamping screw the support foot 22 can be fixed relative to the housing 12 of the power tool 10.

The clamping screw 25, on its right-hand end in the viewing direction, has a pivotably supported pivot lever 30 with an eccentric region, not identified by reference numeral, and on its left-hand end it has a threaded region, also not identified by reference numeral, onto which a threaded nut 252 can be screwed. Steel shims, not identified by reference numeral, are positioned between the pivot lever 30 and the outside of the clamping tab 24 oriented toward it and also between the threaded nut 252 and the outside of the other clamping tab 24 oriented toward it, and guard the aluminum support foot 22 against being worn down upon actuation of the clamping screw 25. The clamping screw 25 passes through circular openings 251 in the clamping tabs 240 of the jacket piece 220.

A longitudinal axis 222 is drawn centrally in the support foot 22, and along it, a jacket piece 220 shown above the support foot 22 can be slipped onto the support foot 22, so that its angled support tabs 240 fit over the outsides of the support tabs 24 of the support foot 22. The jacket piece 220 is dimensioned such that its inside diameter precisely fits the outside diameter of the support foot 22.

Looking downward—as viewed from the clamping tabs 240—the outer edges of the jacket piece 220 lead, increasing in size, radially outward, forming a front recess 310 which is congruent with the windowlike front recess 31 of the support foot 22.

Semi-oval recesses 241 are located in the region of the angled part of the clamping tabs 240 and effect a spring action of the clamping tabs 240 relative to the rest of the jacket piece 220. The jacket piece 220 has a wall thickness of only from 0.5 mm to 3 mm, for example about 1 mm, and is drawn like a second skin over the support foot 22, and in its rear region it has cuplike indentations 190, which considerably improve the grip and the nonslip nature of the power tool 10 with the support foot 22 in the user's hand.

To facilitate the mounting of the support foot 22 on the housing 12, arrowlike symbols, not identified by reference numerals, are stamped into the housing 12 and the support foot 22 and the jacket piece 220, marking those regions that belong together or are to be oriented with one another visibly as such and at the same time describe a mounting motion.

It will be understood that each of the elements described above, or two or more together, may also find a useful application in other types of constructions differing from the types described above.

While the invention has been illustrated and described as embodied in a power tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A power tool, comprising:

a housing having a free end;

a tool protruding from the free end of the housing;

a support foot composed of metal which embraces said tool, is couplable to said housing, and is axially adjustable relative to said housing;

a jacket piece composed, of non-metal which has a first grip surface; first means for improving grip provided on said first grip surface of said jacket piece and enabling a user to safely operate the power tool, and wherein the jacket piece is releasably attached to an outside of the support foot, is dimensioned such that an inside diameter of the jacket piece precisely fits an outside diameter of the support foot, and is substantially congruent to the support foot so that the jacket piece is drawn like a second skin over the support foot; wherein the support foot has a grip region on an outside of the support foot, comprising a second grip surface; and wherein second means for improving grip is provided on the second grip surface of the support foot.

2. A power tool as defined in claim 1, wherein the first means for improving grip comprises a relatively rough outer surface.

3. A power tool as defined in claim 1, wherein the first means for improving grip comprises uniformly distributed indentations.

4. A power tool as defined in claim 3, wherein the uniformly distributed indentations are cup-shaped and have a diameter of 2 to 3 mm.

5. A power tool as defined in claim 1, wherein the jacket piece has a wail thickness of about 1 mm.

6. A power tool as defined in claim 1, wherein the second means for improving grip comprises uniformly distributed indentations.

7. A power tool as defined in claim 6, wherein the uniformly distributed indentations arc cup-shaped and have a diameter of 2 to 3 mm.

8. A power tool as defined in claim 1, wherein the jacket piece is composed of a soft plastic.

9. A power tool as defined in claim 1, wherein the support foot has a back and sides and the grip region is on the back and sides of the support foot.

10. A power tool as defined in claim 1, wherein the housing has a grip region and the housing grip region cooperates with the support foot grip region to form a combination grip region comprising both the housing grip region and the support foot grip region, and wherein third means for improving grip is provided on the housing in the grip region.

11. A power tool, comprising:

a housing having a free end;

a tool protruding from the free end of the housing;

a support foot composed of metal which embraces said tool, is couplable to said housing, and is axially adjustable relative to said housing;

a jacket piece composed of non-metal which has a jacket piece grip surface; first means for improving grip provided on said jacket piece grip surface of said jacket piece and enabling a user to safely operate the power toot and wherein the jacket piece is releasably attached to an outside of the support foot, is dimensioned such that an inside diameter of the jacket piece precisely its an outside diameter of the support foot, and is substantially congruent to the support foot so that the jacket piece is drawn like a second skin over the support foot, wherein the housing has a grip region and the housing grip region cooperates wit the jacket piece grip surface to form a combination grip region comprising both the housing grip region and the jacket piece grip surface, and wherein second means for improving grip is provided on the housing in the housing grip region.

12. A power tool as defined in claim 1, wherein the support foot defines a first front recess and the jacket piece defines a second front recess which is congruent with the first front recess.

13. A power tool as defined in claim 1, wherein the support foot has clamping tabs and the jacket piece has clamping tabs which contact said support foot clamping tabs, and further comprising a clamping screw which fixes said jacket piece clamping tabs on said support foot clamping tabs, said clamping screw fixing the support foot and also passing through said jacket piece clamping tabs.

14. A power tool as defined in claim 1, wherein a clamping screw is means for releasably attaching the jacket piece to the outside of the support foot.

15. A power tool as defined in claim 11, wherein the support foot has a grip region on an outside of the support foot comprising a support foot grip surface, and wherein third means for improving grip is provided on the support foot grip surface.

16. A power tool as defined in claim 11, wherein the first means for improving grip comprises uniformly distributed indentations.

17. A power tool as defined in claim 16, wherein the uniformly distributed indentations are cap-shaped and have a diameter of 2 to 3 mm.

18. A power tool as defined in claim 11, wherein the jacket piece has a wall thickness of about 1 mm.

19. A power tool as defined in claim 11, wherein the jacket piece is composed of a soft plastic.

20. A power tool as defined in claim 11, wherein a clamping screw is means for releasably attaching the jacket piece to the outside of the support foot.

21. A power tool as defined in claim 11, wherein the second means for improving grip comprises uniformly distributed indentations.

22. A power tool as defined in claim 21, wherein the uniformly distributed indentations are cup-shaped and have a diameter of 2 to 3 mm.

* * * * *